US006881114B2

(12) United States Patent
Zheng

(10) Patent No.: US 6,881,114 B2
(45) Date of Patent: Apr. 19, 2005

(54) COLLAPSIBLE FLOATING ASSEMBLY

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 0 days.

(21) Appl. No.: 10/437,740

(22) Filed: May 11, 2003

(65) Prior Publication Data

US 2004/0224583 A1 Nov. 11, 2004

(51) Int. Cl.[7] ..... B63C 9/08
(52) U.S. Cl. ..... 441/129
(58) Field of Search ..... 441/35, 40, 129, 441/130, 131

(56) References Cited

U.S. PATENT DOCUMENTS

| | | | | |
|---|---|---|---|---|
| 1,960,474 | A | | 5/1934 | Browne |
| 4,951,333 | A | | 8/1990 | Kaiser et al. |
| 5,116,273 | A | | 5/1992 | Chan |
| 5,163,461 | A | | 11/1992 | Ivanovich et al. |
| D331,482 | S | | 12/1992 | Mitchell |
| 5,816,954 | A | | 10/1998 | Zheng |
| 5,885,123 | A | | 3/1999 | Clifford |
| 6,098,349 | A | | 8/2000 | Zheng |
| 6,170,100 | B1 | | 1/2001 | Le Gette et al. |
| 6,192,635 | B1 | | 2/2001 | Zheng |
| 6,266,904 | B1 | | 7/2001 | Zheng |
| 6,276,979 | B1 | | 8/2001 | Saltel et al. |
| 6,343,391 | B1 | | 2/2002 | Le Gette et al. |
| 6,360,761 | B1 | | 3/2002 | Zheng |
| 6,408,461 | B1 | | 6/2002 | Zheng |
| 6,478,038 | B1 | | 11/2002 | Le Gette et al. |
| 6,485,344 | B1 | | 11/2002 | Arias |
| 6,519,793 | B1 | | 2/2003 | Le Gette et al. |
| 2003/0143904 | A1 | * | 7/2003 | Morrow et al. ..... 441/12 |
| 2003/0220032 | A1 | * | 11/2003 | Hsu et al. ..... 441/131 |

* cited by examiner

*Primary Examiner*—Stephen Avila
(74) *Attorney, Agent, or Firm*—Raymond Sun

(57) ABSTRACT

An assembly has a floating support having a periphery defined by at least one floatation device, with the periphery defining an interior space. The floating support further includes a first sheet material extending in the interior space and coupled to the floatation device(s). The assembly also has a panel having a foldable frame member that has a folded and an unfolded orientation, and a second sheet material covering portions of the frame member when the frame member is in the unfolded orientation. The panel has opposing end edges that are attached to the periphery of the floating support.

11 Claims, 3 Drawing Sheets

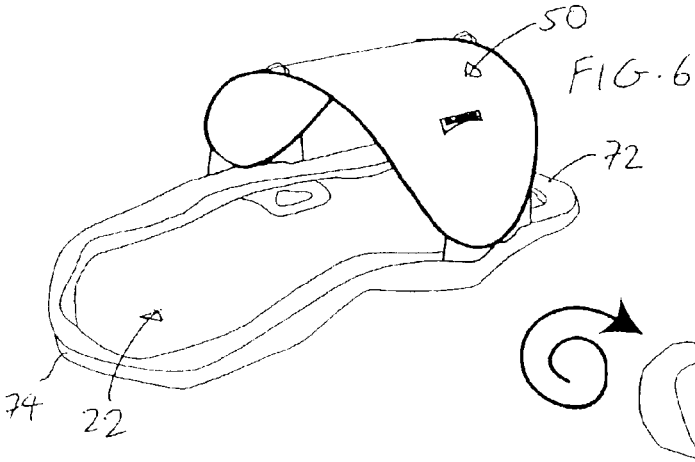
FIG. 6
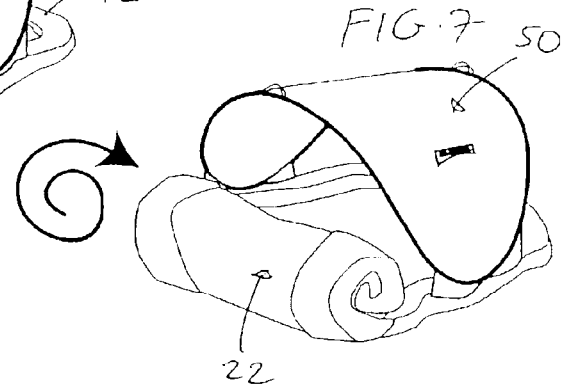
FIG. 7
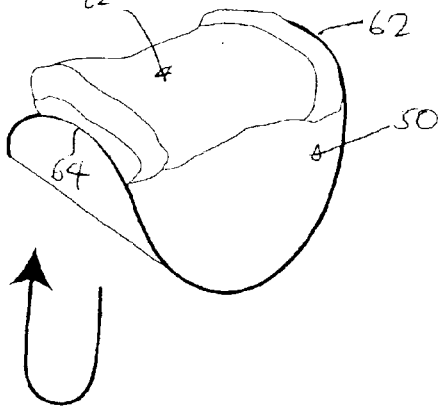
FIG. 8
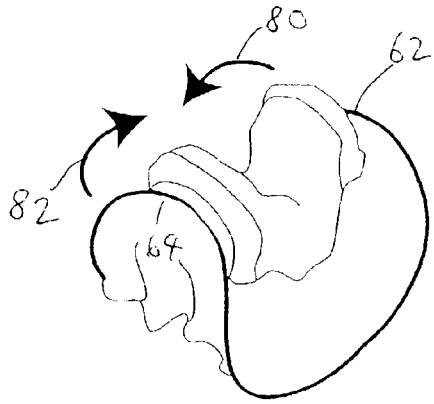
FIG. 9
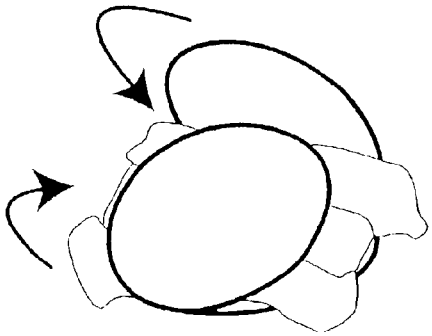
FIG. 10
FIG. 11
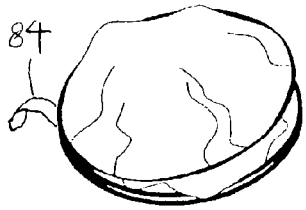

COLLAPSIBLE FLOATING ASSEMBLY

BACKGROUND OF THE INVENTION

1. Field of the Invention

The present invention relates to collapsible structures, and in particular, to a collapsible floating assembly which may be twisted and folded to reduce the overall size of the assembly to facilitate convenient storage and use.

2. Description of the Prior Art

Collapsible objects have recently become popular with both adults and children. Examples of such collapsible objects are shown and described in U.S. Pat. No. 5,038,812 (Norman), U.S. Pat. No. 5,467,794 (Zheng) and U.S. Pat. No. 5,560,385 (Zheng) in the form of collapsible structures. These structures can be used as play structures, shelters, tents, and storage structures, among other uses. These structures may be twisted and folded to reduce the overall size of the structures to facilitate convenient storage and use. As such, these structures are being enjoyed by many people in many different applications.

Other examples of collapsible objects include blanket, mat and floating assemblies as illustrated in one or more of U.S. Pat. No. 6,073,283 (Zheng), U.S. Pat. No. 6,170,100 (Le Gette et al.), and U.S. Pat. No. 6,343,391 (Le Gette et al.). These assemblies can be used as blankets, floor mats, and floating mats. These blankets and mats may be twisted and folded to reduce the overall size of the blanket or mat to facilitate convenient storage and use.

SUMMARY OF THE DISCLOSURE

It is an object of the present invention to provide an improved floating assembly that can be folded and collapsed into a smaller configuration for convenient storage and transportation.

It is another object of the present invention to provide a floating assembly that offers flexibility in use.

It is yet another object of the present invention to provide a floating assembly whose components can be separated for storage and cleaning.

In order to accomplish the objects of the present invention, there is provided an assembly that has a floating support having a periphery defined by at least one floatation device, with the periphery defining an interior space. The floating support further includes a first sheet material extending in the interior space and coupled to the floatation device(s). The assembly also has a panel having a foldable frame member that has a folded and an unfolded orientation, and a second sheet material covering portions of the frame member when the frame member is in the unfolded orientation. The panel has opposing end edges that are attached to the periphery of the floating support.

BRIEF DESCRIPTION OF THE DRAWINGS

FIGS. 6–11 illustrate how the assembly of FIG. 1 can be twisted and folded for compact storage.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
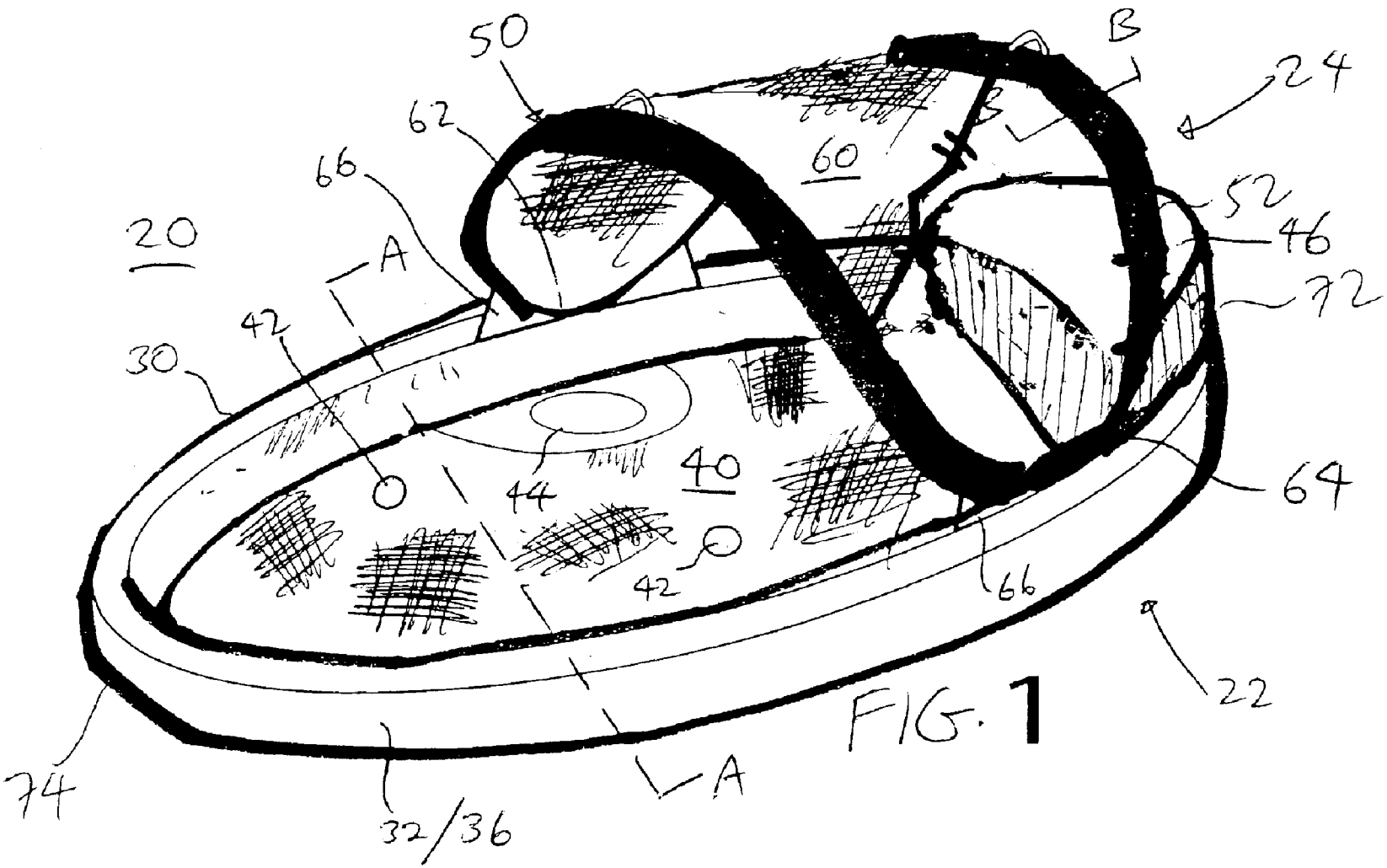
FIG. 1 is a perspective view of a floating assembly according to one embodiment of the present invention shown in use in its expanded configuration.
Figure 2:
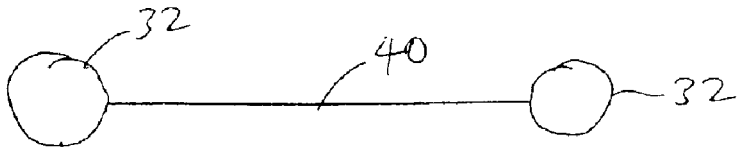
FIG. 2 is a cross-sectional view of the assembly of FIG. 1 taken along line A—A thereof in accordance with one embodiment.
Figure 3:
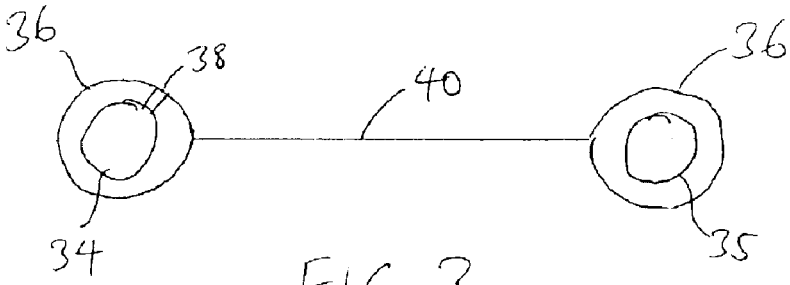
FIG. 3 is a cross-sectional view of the assembly of FIG. 1 taken along line A—A thereof in accordance with another embodiment.

Referring to FIGS. 1, 2 and 3, the present invention provides a floating assembly 20 that can be used as a floating mat for supporting an adult, a child, an animal or any other object on a pool of water. The assembly 20 can assume any configuration, such as circular, oval, rectangular, square, trapezoidal, or irregular. The assembly 20 has two primary components, a floating support 22 and a shade 24.

The floating support 22 has a periphery 30 that is defined by one or more floatation devices. The floatation device(s) can be embodied in several forms. For example, as illustrated in FIG. 2, a single floatation device 32 can be provided which extends around the entire circumference of the periphery 30. As another example, as illustrated in FIG. 3, one or more floatation devices (e.g., FIG. 3 shows two floatation devices 34, 35) can be retained inside a peripheral sleeve 36. The floatation devices 32, 34, 35 can be embodied in any desirable structure, including but not limited to one or more foam pieces, or one or more inflatable bags that are made of plastics, PVC, and similar materials known in the art. FIG. 3 illustrates the use of inflatable bags 34, 35, each of which has a hollow interior that is adapted to receive an inflation medium (e.g., air or liquid) via a port 38 that extends through the sleeve 36. As shown in FIG. 1, the single floatation device 32, or the plurality of floatation devices 34 together, define a generally oval shape that extends completely within the confines of the peripheral sleeve 36.

A sheet material 40 extends within the internal space defined by the peripheral floatation device 32 or the sleeve 36, and is held taut (i.e., in a stretched orientation) by the floatation devices 32 or 34, 35 when the floatation devices 32 or 34,35 are fully inflated. In the embodiment of FIG. 2, if the single floatation device 32 in FIG. 2 is embodied in the form of an inflatable bag, then the floatation device 32 can be stitched directly to the sheet material 40. In the embodiment of FIG. 3, the sheet material 40 can be stitched directly to the sleeve 36. The term "sheet material" is to be given its broadest meaning and should be made from strong, flexible yet lightweight materials and may include woven fabrics, sheet fabrics, meshed fabrics, nylons or even films. The sheet material 40 can be water-resistant and durable to withstand the wear and tear associated with extended use, and rough treatment by adults and children. The sheet material 40 can also allow water to pass therethrough, which can be facilitated by using a meshed material, or by providing openings 42 in the sheet material 40.

Accessories can be provided to the floating support 22. For example, a specifically-shaped opening 44 can be provided on the sheet material 40 adjacent the sleeve 36 or floatation device 32 to function as a cup holder. As another example, an additional inflatable section 46 can be provided at one end 72 (i.e., the "head" end) of the floating support 22 to function as a pillow or cushion. The inflatable section 46 can be embodied in the form of a separate inflatable bag that is stitched or otherwise attached (fixedly or removably) to the sheet material 40, or as part of any of the floatation devices 32, 34, 35 described above and inflated together with them.

Figure 4:
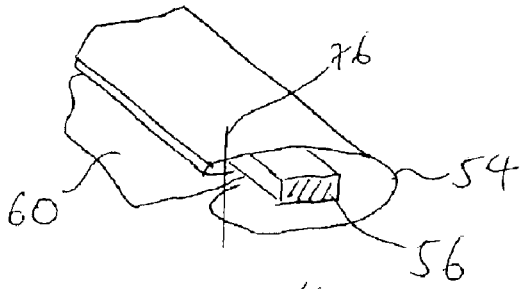
FIG. 4 is a cross-sectional view of the assembly of FIG. 1 taken along line B—B thereof.

The shade 24 can be embodied in the form of a collapsible panel 50. Referring to FIGS. 1 and 4, the panel 50 has a peripheral edge 52 that is defined by a peripheral frame retaining sleeve 54. A continuous frame member 56 is retained or held within the frame retaining sleeve 54 such that the frame member 56 extends completely around the peripheral edge 52.

The continuous frame member 56 may be provided as one continuous loop, or may be a strip of material connected at both ends to form a continuous loop. The continuous frame member 56 is preferably formed of flexible coilable steel, although other materials such as plastics may also be used. The frame member 56 should be made of a material which is relatively strong and yet is flexible to a sufficient degree to allow it to be coiled. Thus, the frame member 56 is capable of assuming two positions, an open or expanded position such as shown in FIG. 1, or a folded position (see FIG. 11) in which the frame member is collapsed into a size which is much smaller than its open position. The frame member 56 may be merely retained within the frame retaining sleeve 54 without being connected thereto. Alternatively, the frame retaining sleeve 54 may be mechanically fastened, stitched, fused, or glued to the frame member 56 to retain the frame member 56 in position.

A sheet material 60 extends within the internal space defined by the frame retaining sleeve 54, and is held taut by the frame member 56 when the frame member 56 is in its open position. The sheet material 60 can be made from any of the materials described above for the sheet material 40. The sheet material 60 is attached to the frame retaining sleeve 54, which may be formed by folding a piece of fabric and applying a stitching 76.

Figure 5:
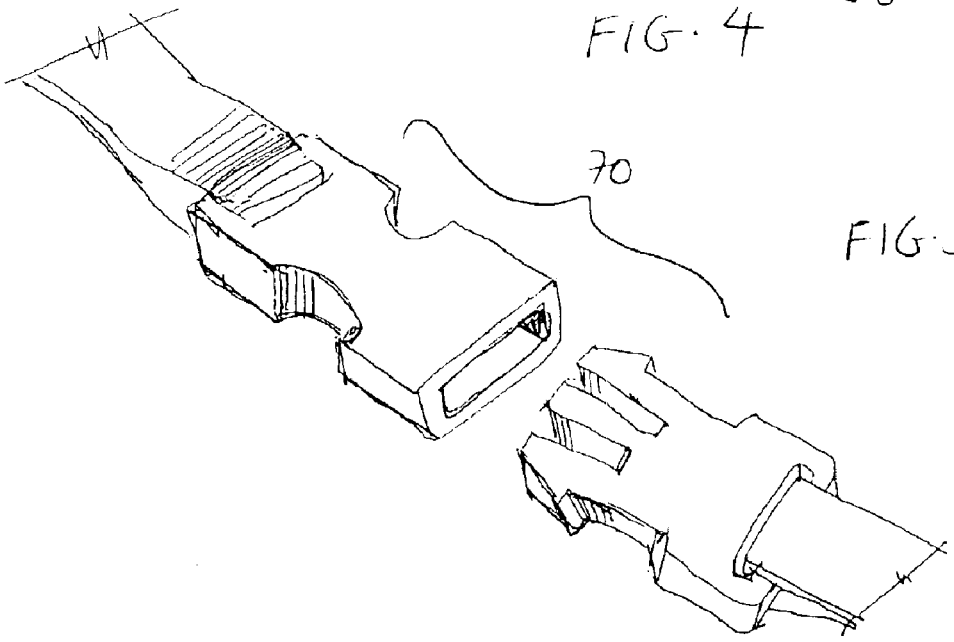
FIG. 5 illustrates a removable attachment mechanism that can be used to removably attach the shade to the floating support in FIG. 1.

The panel 50 can have a generally rectangular or oval configuration, and has two opposing end edges 62 and 64. Each end edge 62, 64 can be either fixedly or removably attached to the sleeve 36 or the floatation device 32 on opposite sides of the floating support 22 adjacent one end of the floating support 22, preferably adjacent the head end 72 of the floating support 22 where the pillow 46 is positioned. For example, FIG. 1 illustrates that the end edges 62, 64 are fixedly attached to the sleeve 36 or the floatation device 32 by stitching, with interconnecting fabric portions 66 provided to further facilitate this attachment by filling in the rounded corners of the end edges 62, 64. FIG. 5 illustrates the use of a snap buckle 70 to removably connect the end edges 62, 64 to the sleeve 36 or the floatation device 32. The removable connection between the end edges 62, 64 and the sleeve 36 or the floatation device 32 can also be accomplished by other known removable attachment mechanisms, such as but not limited to VELCRO™ pads, hooks, toggles and latches.

The flexible and coilable nature of the frame member 56 allows the panel 50 to be flexed so that the end edges 62, 64 can be attached to the sleeve 36 or the floatation device 32 to enclose a covered space between the panel 50 and the floating support 22. In this regard, the flexing of the panel 50 obviates the need to provide a plurality of panels to enclose the covered space. The floating support 22 functions to hold the panel 50 in its flexed configuration.

In use, the user can inflate the floatation device(s) 32, 34, 35 and then place the assembly 20 onto a body of water (e.g., swimming pool, beach, lake, etc.). The user can then climb on to the top surface of the sheet material 40 and then lie on the assembly 20 as the assembly 20 floats on the water. The user can position his or her head on the pillow 46, so that the panel 50 can function to shade the user's head from the sunlight.

FIGS. 6–11 illustrate one method for collapsing and storing the assembly 20. First, as shown in FIG. 6, the user deflates the floatation device(s) 32, 34, 35 so that the entire floating support 22 can have a generally flat profile. Next, as shown in FIG. 7, the floating support 22 can be rolled up from the foot end 74 towards the head end 72, until the entire rolled-up floating support 22 is positioned under the panel 50 (see FIG. 8). At this time, the assembly 20 can be folded and collapsed into a compact configuration for storage. As shown in FIG. 9, the opposite end edges 62, 64 of the panel 50 are folded in (see arrows 80 and 82) to collapse the frame member 56 with the sheet material 60. The floating support 22 is collapsed and folded along with the panel 56 because the materials used for the floating support 22 are soft and flexible. As shown in FIG. 10, the next step is to continue the folding and collapsing so that the initial size of the panel 50 is reduced. FIG. 11 shows the next step with the frame member 56, sheet material 60, and the floating support 22 collapsed on each other to provide for a small essentially compact configuration having a plurality of concentric frame members 56 and layers of the sheet material 60 so that the collapsed assembly 20 has a size which is a fraction of the size of the initial assembly 20.

In addition, a retaining member or strap 84 (shown in FIG. 11 only) may be attached to the peripheral edge 52 of the panel 50, and may be used to tie or hold the collapsed assembly 20 in the collapsed position. Alternatively, a bag (not shown) may be used to store the collapsed assembly 20.

The assembly 20 can be expanded again by opening the coiled frame member 56. The bias and resiliency of the frame member 56 will cause the frame member 56 (and the attached sheet material 60) to automatically open out to the expanded position shown in FIG. 8. At this point, the floating support 22 can be unrolled (i.e., by reversing the steps shown in FIGS. 6–8) and the user can re-inflate the floatation device(s) 32, 34, 35 for use.

If the panel 50 is removably attached to the floating support 22, the panel 50 can be separated from the floating support 22 so that either the panel 50 or the floating support 22 (or both) can be washed or replaced (if defective) separately. For example, different shades 24 (each having different indicia or designs imprinted on the sheet material 60) can be alternated for use by the user as desired. In addition, the panel 50 and the floating support 22 can be collapsed and stored separately. For example, the floating support 22 can be rolled up for storage, and the panel 50 can be twisted and folded according to the steps shown in FIGS. 9–11 to reduce the size of the panel 50 for storage.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. An assembly, comprising:

a floating support having a periphery defined by at least one floatation device which extends around the entire circumference of the periphery, with the periphery defining an interior space, the floating support further including a first sheet material extending in the interior space and coupled to the floatation device; and a panel having a foldable frame member that has a folded and an unfolded orientation, and a second sheet material covering portions of the frame member when the frame member is in the unfolded orientation, the panel having opposing end edges that are removable attached to the periphery of the floating support.

2. The assembly of claim 1, further including at least opening provided in the first sheet material.

3. The assembly of claim 1, wherein the opposing end edges are attached to the periphery of the floating support along opposite sides of the periphery.

4. The assembly of claim 1, wherein the opposing end edges are attached to the periphery of the floating support at one end of the floating support.

5. The assembly of claim 4, including a pillow coupled to the one end of the floating support under the panel.

6. The assembly of claim 1, wherein the panel has a flexed configuration.

7. The assembly of claim 1, wherein the frame member forms a plurality of concentric frame members when it has been twisted and folded into the folded orientation.

8. The assembly of claim 1, wherein the floatation device is exposed to ambient.

9. The assembly of claim 1, wherein the periphery is devoid of a sleeve.

10. The assembly of claim 1, wherein the at least one floatation device is a single floatation device.

11. The assembly of claim 1, wherein the first sheet material extends in the interior space and is directly attached to the floatation device.

* * * * *